US006601363B2

(12) United States Patent
Richard

(10) Patent No.: US 6,601,363 B2
(45) **Date of Patent: *Aug. 5, 2003**

(54) MOBILE HOME FOUNDATION AND METHOD

(76) Inventor: Danny J. Richard, 799 Fort Hamilton Dr., Opelousas, LA (US) 70570

( * ) Notice: Subject to any disclaimer, the term of this patent is extended or adjusted under 35 U.S.C. 154(b) by 0 days.

This patent is subject to a terminal disclaimer.

(21) Appl. No.: 10/205,758

(22) Filed: Jul. 26, 2002

(65) Prior Publication Data

US 2003/0009982 A1 Jan. 16, 2003

Related U.S. Application Data

(63) Continuation of application No. 09/933,539, filed on Aug. 20, 2001, now Pat. No. 6,449,920, and a continuation of application No. 09/428,663, filed on Oct. 28, 1999, now Pat. No. 6,295,784.

(51) Int. Cl.[7] ..... E04B 1/00
(52) U.S. Cl. ..... 52/741.15; 52/169.9; 52/DIG. 11
(58) Field of Search ..... 52/741.15, 169.9, 52/DIG. 11, 341.15, 169.12, 299, 341.11

(56) References Cited

U.S. PATENT DOCUMENTS

| | | | |
|---|---|---|---|
| 3,653,168 | A | 4/1972 | Cook |
| 3,762,111 | A | 10/1973 | Harada |
| 3,879,905 | A | 4/1975 | Catalano, Sr. |
| 3,972,170 | A | 8/1976 | Brammer |
| 4,180,952 | A | 1/1980 | Vanderlyn |
| 4,517,781 | A | 5/1985 | LeBlanc |
| 5,152,108 | A | 10/1992 | Madl, Jr. |
| 5,784,844 | A | 7/1998 | Mackarvich |
| 5,956,907 | A | 9/1999 | Martin |
| 6,141,936 | A | 11/2000 | Butler, Jr. |

FOREIGN PATENT DOCUMENTS

| | | |
|---|---|---|
| SU | 591551 | 2/1978 |

*Primary Examiner*—Lanna Mai
*Assistant Examiner*—Hanh V. Tran
(74) *Attorney, Agent, or Firm*—Dominique & Waddell, PLC

(57) ABSTRACT

A mobile home and foundation system and method. The method includes providing a plurality of elongated concrete slabs having a pair of beveled edge surfaces. The plurality of elongated concrete slabs are placed within elongated ditches formed in the ground and to which the mobile home is secured. A fastener assembly is secured to the concrete slabs and a constraint device is connected to the fastener assembly. The foundation system includes a plurality of elongated slabs having a beveled edge.

10 Claims, 3 Drawing Sheets

MOBILE HOME FOUNDATION AND METHOD

This application is a continuation of original application Ser. No. 09/428,663 filed Oct. 28, 1999, now U.S. Pat. No. 6,295,784, and of continuation application Ser. No. 09/933,539 filed on Aug. 20, 2001, now U.S. Pat. No. 6,449,920.

BACKGROUND OF THE INVENTION

1. Field of the Invention

The present invention relates to a precast and transportable mobile home foundation system. More specifically, the present invention relates to a method and apparatus for securing a mobile home to the ground by utilizing a plurality of elongated concrete slabs that are placed within elongated ditches formed in the ground and to which the mobile home is secured.

2. Discussion of the Related Art

Mobile homes have been used to provide a living facility that can be moved from one location to another. The typical mobile home includes a housing unit that is mounted onto a frame. The frame is usually a assembly of steel I-beams that includes wheels and a coupling section for attaching to a towing vehicle for moving the mobile home from one location to another. At the installation site the mobile home is jacked-up to remove weight from the wheels and stacks of cinder or cement blocks are placed between the ground and the I-beam frame at predetermined locations. The wheels can then be removed and the mobile home lowered into position so that it rests on the stacks of blocks that serve as its foundation.

In most states safety rules require that mobile homes be anchored to the ground to reduce the chances of them blowing over in high winds. One type of specification requires that metal strapping be used by extending it over the structure of the mobile home. This overhead strapping is typically installed during manufacture. The siding and roof are placed over the overhead strapping, with the strapping sandwiched between the mobile home upper frame structure and the siding and roof. A plurality of such straps will usually be placed along the length of the mobile home. The straps are typically flexible sheet metal, preferably galvanized steel, and are approximately 1 to 2 inches, preferably about 1.25 inches in width. The ends of the overhead straps protrude below the lower edge of the mobile home and are secured to anchors embedded in the ground.

One problem associated with the use of straps occurs during settling of the foundation. For example, as the mobile home settles, at least some of the straps can become loose. It is common that settling will not be uniform from one end and/or side of the mobile home to the other. That is, one end or side of the mobile home will usually settle more than the other end or side. Thus, from time to time the mobile home owner is faced with the expense of having to have the mobile home releveled and the straps retighened. In many cases, the homeowner ignores the loosened straps and faces the danger of the mobile home becoming unstable during high winds.

Several factors should be balanced when providing a foundation for mobile homes. One factor is the condition of the ground on which the mobile home is to be located. In some locations the surface of the ground can be relatively unstable during certain times of the year due to excessive rains or thaw. It is difficult to provide an adequate and safe foundation for a mobile home under such conditions. The mobile home often cannot be placed on such locations until the ground is considered firm enough to support the mobile home and its foundation. A second factor is that the foundation should provide enough stability to adequately prevent the mobile home from being dislodged by high winds. A third factor is that the foundation should be portable enough so that it can be moved from location to location. Also, in some locations it is important that the foundation not be considered a permanent structure in order for it to be exempt from real estate taxes and more stringent building permits. In this regard, prior art devices and techniques have been deficient insofar as those foundations that provide reasonably good support tend to be of a permanent nature, and therefor subject to taxes and more stringent permits. Additionally, those prior art support structures that are light and portable enough to be exempt from such requirements, such as stacks of cinder blocks, fail to provide the necessary stability and support for the mobile home, especially during high wind situations.

U.S. Pat. No. 3,879,905 to Catalano, Sr. discloses a previous attempt to support a mobile home on the ground that includes the use of a plurality of concrete support assemblies 20. Each of the concrete support assemblies 20 include a plurality of upwardly projecting, spaced-apart support structures 24, 26. Each of the upwardly projecting support structures 20 receives one of the steel I-beams of a mobile home. The I-beam is connected to the upwardly projecting support structure by a strap 40.

One problem associated with Catalano's concrete support assemblies is that each assembly requires the use of two spaced apart upwardly projecting support structures 24 and 26. The upwardly projecting support structures 24, 26 are integrally formed with the base 22 during the casting of the support assembly 20. Thus, difficulties are encountered when the mobile home is wheeled on top of the concrete assemblies 20 at the dwelling location due to the interference between the I-beams 14, 16 and the upwardly projecting support structures 24, 26.

Accordingly, it is an object of the present invention to provide a precast transportable foundation system for mobile homes that can be easily positioned, even on soft ground. It is also an object of the present invention to provide a method for positioning a mobile home over a foundation structure comprised of a plurality of low profile concrete slabs and fixedly connecting it to them. It is a further object of the present invention, to provide an apparatus and method for supporting a mobile home that can be economically manufactured offsite so as to minimize the amount of time and effort required to install the supporting system at the site.

SUMMARY OF THE INVENTION

In accordance with one exemplary embodiment of the present invention there is provided a foundation system for a mobile home having a living unit supported on a steel beam frame, which foundation system comprises:

- a plurality of elongated concrete slabs, each of said concrete slabs having a bottom surface, a pair of side surfaces, a pair of end surfaces, a top surface and a pair of beveled edge surfaces, each of said beveled edge surfaces extending between said top surface and one of said side surfaces;
- at least two fastener assemblies each having a first portion and a second portion, said first portion being disposed within each of said concrete slabs, said second portion projecting from said top surface of said concrete slab;
- at least one constraint device having a first end, a second end and a middle portion extending between said first and second ends, said first and second ends being capable of fastening to said fastener assemblies.

In a preferred embodiment of the present invention the constraint device is a flexible strap, more preferably of galvanized steel.

In another preferred embodiment of the present invention the elongated concrete slabs contain one or more blind bores at at least one of their ends.

In a preferred embodiment of the present invention there is provided a method for securing a mobile home to the ground, said mobile home having a housing containing the living facilities mounted on a steel beam frame, and wheels for supporting the frame, which method comprises:

providing at least one elongated concrete slab characterized as having a bottom surface, a pair of side surfaces, a pair of end surfaces, a top surface and a pair of beveled edge surfaces, such that each of the beveled edge surfaces extend between the top surface and one of the side surfaces;

digging at least one elongated ditch in the ground to which the mobile home is to be secured said at least one elongated ditch being at a depth that will cover at least a portion of said side surfaces;

placing said at least one elongated concrete slab in at least one of said elongated ditch at a depth such that at least the top surface is exposed;

positioning a mobile home over said concrete slab so that said elongated concrete slab is situated underneath a portion of said steel beam frame;

placing a support system between said mobile home and said concrete slab so that said steel beam frame of said mobile home rests on said support system;

securing at least two fastener assemblies to the top surface of said concrete slab so that they are aligned under a section of said steel beam so that one fastener assembly is on one side of said steel beam the other fastener assembly on the other side of said steel beam;

connecting a first end of a constraint device to one of said at least two fasteners;

passing the constraint device around the steel beam between the mobile home and said steel beam;

connecting the second end of said constraint device to the second of the at least two fasteners, thereby securing the mobile home to the concrete slab.

In a preferred embodiment of the present invention a plurality of ditches is dug, which ditches are approximately the width of said mobile home and which ditches are substantially parallel to each other and spaced a predetermined distance apart along the length of the mobile home.

In another preferred embodiment of the present invention the elongated ditches and concrete slabs are situated substantially transverse to the longitudinal axis of the mobile home.

In another preferred embodiment of the present invention the constraint device is a galvanized steel strap.

BRIEF DESCRIPTION OF THE FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
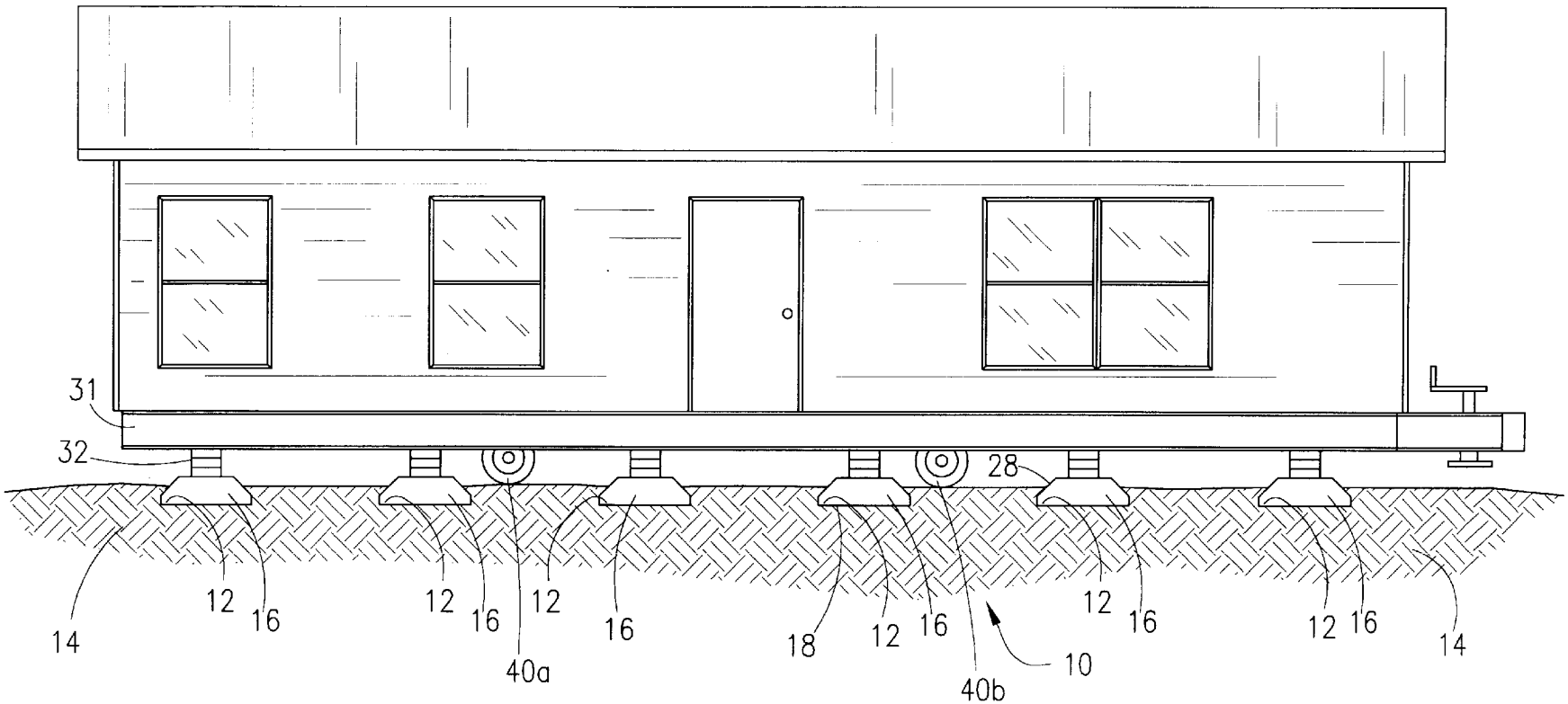
FIG. 1 is a top front elevational view showing a mobile home supported by the foundation system according to the present invention.

The foundation system of the present invention greatly reduces the amount of settling of a mobile home when placed at its' desired site on the foundation system. This in turn reduces the amount of stress put on various parts of the mobile home, and thus results in substantially fewer cracks in the housing unit. Reduction of settling will also result in improved holding power of the fastener assemblies used to secure the mobile home to the foundation system.

Referring now to FIGS. 1–6, a mobile home foundation assembly 10 is illustrated. The assembly is formed by first digging a plurality of elongated, essentially rectangular boxed shape ditches 12 in the ground 14. One of a plurality of elongated concrete slabs 16 is placed within one of the ditches. The elongated slabs are spaced apart along the length of the mobile home to be supported. The space between the slabs will be any suitable spacing as long as sufficient support and weight is provided for the mobile home. A sufficient weight will be one that will anchor the mobile home to the ground during high wind situations. Typically the slabs will be spaced from about 6 to 10 feet apart, preferably from about 7 to 9 feet apart. Each concrete slab has a bottom surface 18, a pair of side surfaces 22, a pair of end surfaces 24, a top surface 26 and a pair of beveled edge surfaces 28. Each of the beveled edge surfaces 28 extends between top surface 26 and one of the side surfaces 22. The top surface 26 is substantially planar. The concrete slabs may also contain one or more, preferably two, blind bores 25 for receiving a connecting rod for connecting two concrete slabs together. The overall dimensions of the elongated concrete slabs are not critical and will vary with the condition of the ground as well as the size of the mobile home. A typical slab will be about ½ foot high, by about 2 feet wide, and about 3 to 13 feet long.

When a concrete slab 16 is placed in a ditch 12, at least the top surface 26 of the slab is exposed above the ground surface. It is preferred that at least a portion of the beveled edges also be exposed. The beveled edges are provided to allow the wheels 40*a*, 40*b* of the mobile home to more easily roll over the concrete slabs during positioning of the home over the foundation system. It is within the scope of the present invention that at least a portion of the side surfaces 22 of the elongated slabs also be exposed. It is important that at least enough of the concrete slab 16 be disposed below the ground to prevent the slab from undesirably shifting during placement of the mobile home over the foundation system. Therefore, when slab 16 is placed within the ground it has a relatively low profile so that little of it is exposed above the ground surface. Thus, when the mobile home is rolled into position over slabs 16 at the dwelling location, there is sufficient clearance for the steel beams 30, 31 to clear over the top surface 26 of each of the slabs 16. It is within the scope of this invention that the mobile home be lifted onto the foundation system with a suitable lifting device, such as a crane. Once the mobile home is positioned with respect to slabs 16, the mobile home is raised (jacked-up), and a plurality of cement, or cinder, blocks 32 are inserted underneath the mobile home. That is, the steel I-beams will rest on the blocks that sit on the top surface 26 of each slab 16. The number and size of the blocks 32 will vary to ensure the proper leveling of the mobile home and will be done in a manner known to those skilled in the art. The blocks, of course, will be stacked high enough to take the weight off of the wheels 40*a*, 40*b* so that they can be removed if desired. Although it is preferred that the concrete slabs be placed in the ground transverse to the longitudinal axis of the mobile home, it will be understood that they can also be placed parallel to the longitudinal axis such that they run along the length of and underneath one or more of the steel beams of the mobile home frame.

Figure 2:
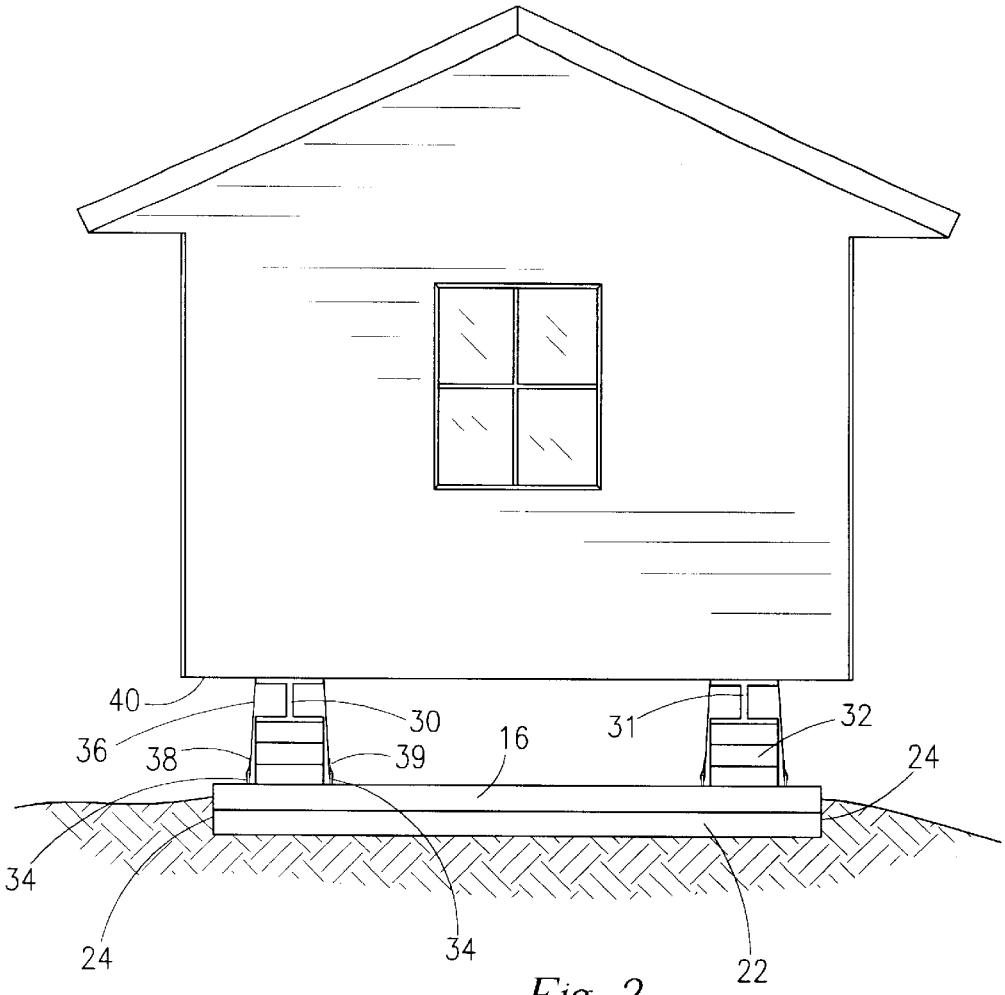
FIG. 2 is a left side elevational view of the mobile home foundation shown in FIG. 1.
Figure 3:
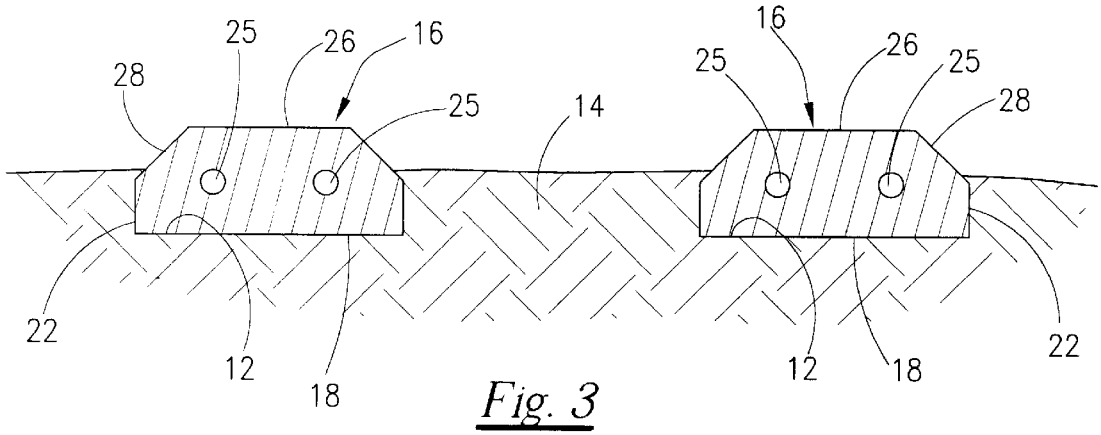
FIG. 3 is an enlarged partial front sectional view of two elongated concrete slabs of the present invention.
Figure 4:
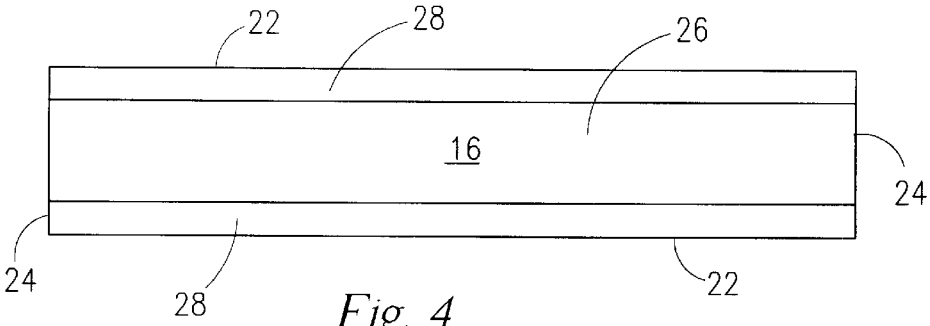
FIG. 4 is a top view of one elongated concrete slab of the present invention.
Figure 5:
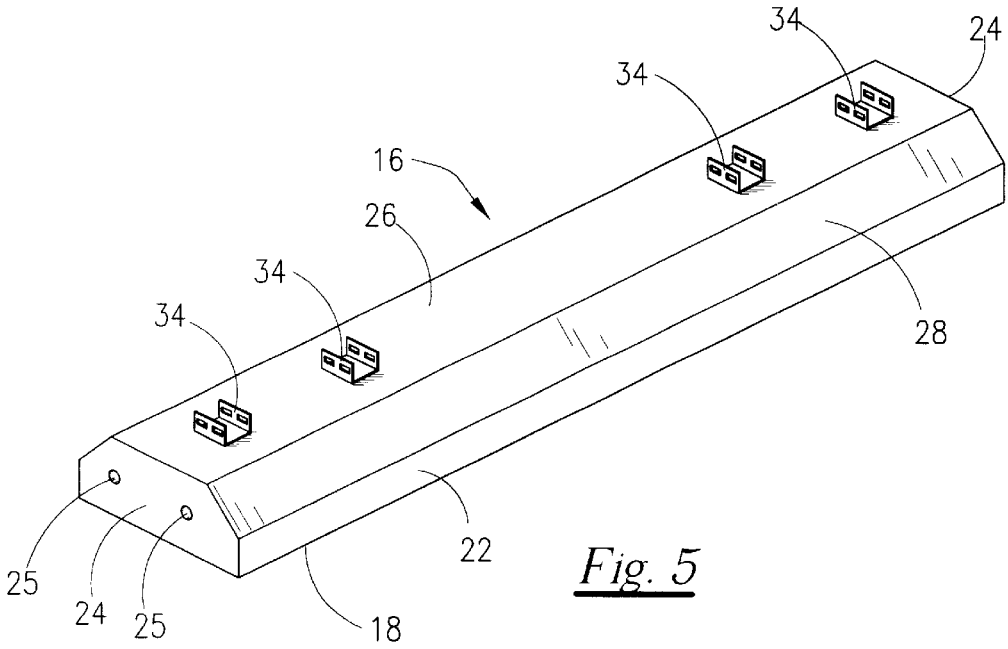
FIG. 5 is a perspective view of an elongated concrete slab of the present invention.

Anchors 34 project upwardly from top surface 26 of each of the slabs 16. In a preferred embodiment, the anchor is a U-shaped concrete slab anchor, such as those available from Tie Down Engineering, Atlanta, Ga. and having a Model No. MICS2 and Part No. 59125. Two sets of these anchors are shown secured to concrete slab 16 in FIG. 5 hereof The anchors can be secured to concrete slab 16 by any suitable means. One preferred method is to use an expansion anchor bolt (not shown) that is embedded into concrete slab 16. The bottom of the U-shaped anchor is secured to the anchor bolt by the corresponding nut so that the sides extend upward. The sides of the preferred anchor 34 shown in FIG. 5 contain cut-outs to receive bolts that secure a constraint device thereto. A preferred constraint device is metal strapping, preferably galvanized metal strapping of suitable width. A suitable width will typically range from about 1 to 2 inches. One end of the strapping is secured to an anchor 34 and the strapping is passed between a steel beam of the mobile home frame and the mobile home wherein it's other end is secured to another anchor 34. In other words, a pair of anchors 34 is used for each steel beam that passes over the concrete slab 16. The galvanized strapping is of the type that is also available from Tie Down Engineering of Atlanta, Ga. As illustrated in FIG. 2, strap 36 has a first end connected to a first fastener 34. The strap is then guided around steel I-beam 30 between the flame 40 of the mobile home and the I-beam 30. The other end 40 of strap 36 is then connected to a second fastener 34. As illustrated in FIG. 2, strap 36 can be looped at least once around the steel I-beam 32 before it is connected to the second fastener.

It is be understood that the U-shaped anchors and galvanized strapping are only preferred embodiments herein and that any other suitable concrete anchors and constraint devices can be used. For example, the strapping can also be a metal chain or woven nylon of sufficient strength for this purpose.

Figure 6:
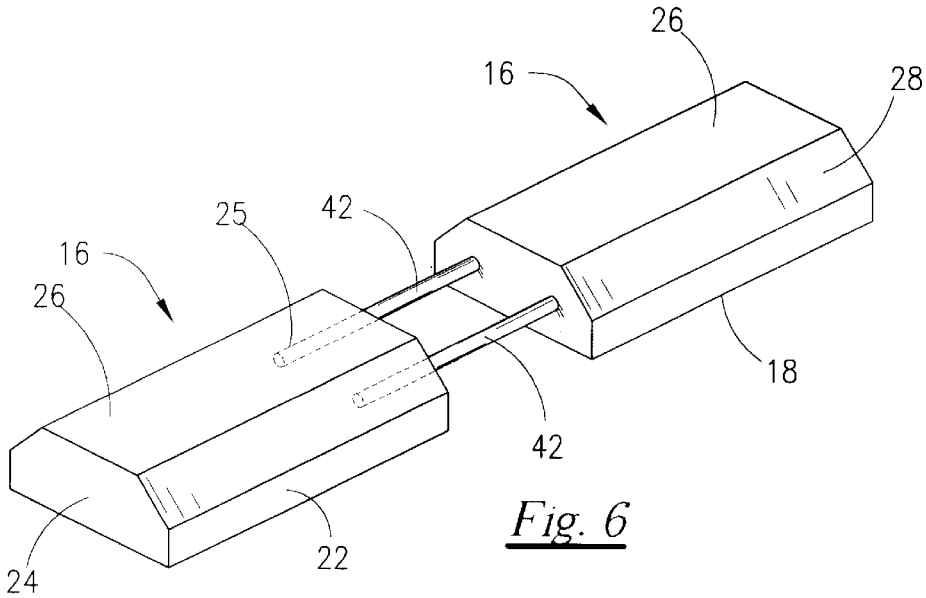
FIG. 6 is a top view of the first two pairs of elongated concrete slabs that are placed along the length of a "double-wide" mobile home.

FIG. 6 shows another embodiment of the present invention wherein two rows of elongated concrete slabs 16 are used as a foundation for a so-called "double-wide" mobile home. Each side of the mobile home is set in place and secured to its properly placed row of elongated concrete slabs as described above. It is preferred that each pair of opposing elongated concrete slabs be connected to each other in a double-wide application. That is, when two mobile homes are joined side by side. One preferred way of doing this is to provide each concrete slab 16 with a set of blind bores 25 within its opposing end 24. An elongated metal rod 42, or dowel, can be inserted in the opposing or facing blind bores in order to hold, and maintain the slabs in position with respect to each other.

Having described the presently preferred exemplary embodiment of a mobile home foundation in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A foundation system for supporting a mobile home, the mobile home having a living unit supported with a first steel beam and a second steel beam on an underside of said mobile home, said first and second steel beam being positioned along a longitudinal axis of the mobile home, said mobile home having wheels for transporting the mobile home, said foundation system comprising:

a plurality of elongated concrete slabs, each of said concrete slabs having a bottom surface, a pair of side surfaces, a pair of end surfaces, a top surface and a pair of edge surfaces, each of said edge surfaces extending between said top surface and one of said side surfaces, wherein each elongated concrete slab is embedded in a rectangular box-shaped ditch so that at least a portion of the edges are exposed with a low profile, and wherein the low profile of said exposed edge allows the wheels of the mobile home to be rolled over;

and wherein said plurality of elongated concrete slabs are placed in a first row and a second row transverse to the longitudinal axis of said mobile home's first steel beam and said second steel beam.

2. The foundation system of claim 1 wherein at least one of said elongated concrete slabs including at least two fastener assemblies each having a first portion and a second portion, said first portion being disposed within each of said concrete slabs, said second portion projecting from said top surface of said concrete slab, said fastener assemblies receiving and securing a constraint device for constraining said mobile home to at least one of said concrete slabs.

3. A method for forming a mobile home foundation, said mobile home having living facilities mounted on a steel beam frame, and wheels for transporting the mobile home, said method comprising the steps of:

providing a plurality of elongated concrete slabs comprising a bottom surface, a pair of side surfaces, a pair of end surfaces, and a top surface;

digging a plurality of elongated ditches in the ground to which the mobile home is to be positioned, said elongated ditches being at a depth that will cover at least a portion of said side surfaces, said elongated ditches being dug in the ground traverse to the longitudinal axis of the mobile home, and wherein said elongated ditches contain said elongated concrete slabs and wherein said elongated concrete slabs are approximately the width of said mobile home and which are substantially parallel to each other and which are spaced a predetermined distance apart along the length of the mobile home;

placing said elongated concrete slabs in said elongated ditches at a depth such that at least the top surface is exposed;

rolling the wheels of the mobile home over said top surface of said elongated concrete slabs;

positioning the mobile home over said concrete slabs so that said elongated concrete slabs situated underneath a portion of said steel beam frame;

placing a support system between said mobile home and said concrete slabs so that said steel beam frame of said mobile home rest on said support system.

4. The method of claim 3 further comprising:

securing at least two fastener assemblies to the top surface of said concrete slab so that they are aligned under a steel beam so that one fastener assembly is substantially underneath one side of the beam the other fastener assembly is substantially underneath the other side of the beam;

connecting a first end of a constraint device to one of said at least two fasteners;

passing the constraint device between the steel beam and the living facilities of the mobile home; and connecting the second end of said constraint device to the second of the at least two fasteners, thereby securing the mobile home to the concrete slab.

5. The method of claim 3 further providing a pair of beveled edge surfaces on said elongated concrete slabs and wherein at least the beveled edges of concrete slabs are exposed above the ground.

6. The method of claim 4 wherein the constraint device is a flexible steel strap.

7. The method of claim 6 further comprising the step of wrapping the flexible steel strap at least once around the steel beam before the step of connecting the second end of the constraint device.

8. The method of claim 5 further comprising the step of providing two substantially parallel rows of elongated concrete slabs, each row being spaced from each other and each row being placed transverse along the longitudinal axis of each of two side of a double wide mobile home.

9. The method of claim 8 further comprising the step of connecting at least one pair of opposing concrete slabs to each other.

10. The method of claim 8 wherein the facing ends of the at least one pair of opposing concrete slabs contains at least one blind bore for receiving an elongated connecting rod.

* * * * *